US007096521B2

(12) United States Patent
Rifkin

(10) Patent No.: US 7,096,521 B2
(45) Date of Patent: Aug. 29, 2006

(54) BEVERAGE HOLDER WITH ADVERTISING DISPLAY TO BE MOUNTED ON A FLUSH VALVE WITH ZERO MODIFICATION

(76) Inventor: Josh Rifkin, 36 Barbaree Way, Tiburon, CA (US) 94920

( * ) Notice: Subject to any disclaimer, the term of this patent is extended or adjusted under 35 U.S.C. 154(b) by 174 days.

(21) Appl. No.: 10/855,007

(22) Filed: Aug. 1, 2003

(65) Prior Publication Data

US 2005/0050631 A1 Mar. 10, 2005

(51) Int. Cl.
*A47K 1/08* (2006.01)

(52) U.S. Cl. ..... 4/661; 4/300; 248/311.2

(58) Field of Classification Search ..... 4/300, 4/301, 661; 220/737; 248/311.2, 205.5
See application file for complete search history.

(56) References Cited

U.S. PATENT DOCUMENTS 4,683,598 A * 8/1987 Jones ..... 4/301
5,106,046 A * 4/1992 Rowles et al. ..... 248/311.2
5,169,108 A * 12/1992 Carlson ..... 248/311.2
5,695,162 A * 12/1997 DiCastro ..... 248/231.81
6,243,885 B1 * 6/2001 Lopez-Torres, Jr. ..... 4/300
6,325,350 B1 * 12/2001 Mancuso ..... 248/311.2

* cited by examiner

*Primary Examiner*—Tuan Nguyen
(74) *Attorney, Agent, or Firm*—Richard Esty Peterson

(57) ABSTRACT

A beverage holder with advertising display providing a slot at the top of the display for the placement of an advertisement card, the beverage holder being designed to be attached to a flush valve housing in a commercial sanitary fixture such as a urinal or toilet without modification to the flush valve, the beverage holder having a base with a threaded opening for a long threaded shaft to hold a clear plastic display mounted on top of said shaft as a changeable eye level advertisement and a plurality of depending legs with end teeth that engage the flush valve housing of the sanitary fixture.

14 Claims, 9 Drawing Sheets

BEVERAGE HOLDER WITH ADVERTISING DISPLAY TO BE MOUNTED ON A FLUSH VALVE WITH ZERO MODIFICATION

FEDERALLY SPONSORED PROGRAM

Not Applicable

SEQUENCE LISTING OR PROGRAM

Not Applicable

BACKGROUND

1. Field of Invention

The present invention relates to the field of holders for beverage containers and advertising displays, more particularly, to a beverage container holder and advertising display configured for mounting on a flush valve such as found on commercial urinals and toilets.

2. Description of Prior Art

Commercial sanitary fixtures such as urinals and toilets are used in many public settings. These fixtures are installed in buildings and facilities where large groups of people come together for sporting events, concerts, conferences, and other gatherings. In addition, these fixtures are also commonly found in restaurants, bars and nightclubs.

The public attending sporting events, music concerts, conferences or nightclubs will eventually visit the restroom where those fixtures are installed. Quite often, a person will carry a drink container of some kind, a cup, bottle or glass to the restroom and find that there isn't a safe place to rest their beverage. Commonly, the person may try to balance the beverage container upon the edge of the sanitary fixture, often resulting in a spilled drink, or broken bottle, and liquid and glass covering the floor of the restroom. Such a spill creates a highly unsafe condition for all patrons, and frustration for the patron who accidentally spills his/her beverage.

Advertising in a restroom setting usually requires considerable augmentation to the walls of the restroom. Commonly, a glass frame or corkboard has to be mounted on the tile wall, which requires a drill, screws and the time and labor of an individual.

In my search for similar patents I found only one invention that resembled mine. U.S. Pat. No. 6,243,885, titled "Flush valve mounted beverage holder and associated method." Invented by Lopez-Torres, Jr. I found that U.S. Pat. No. 6,243,885 suffered from a number of disadvantages:

(a) The invention requires the removal of the existing flush valve cover.

(b) The removal of the flush valve cover requires the use of additional tools.

(c) The unused heavy and bulky flush valve cover will require a substantial storage facility.

(d) The advertising display is located far below eye level. Additionally, the display opening only allows for a logo or limited amount of text (e) Removing, storing the flush valve cover and attaching the new augmentation will take a great deal of time and labor especially in the consideration of a large installment such as a stadium.

(f) The invention requires several embodiments to provide additional functions such as a cigarette holder or the installation on an automatic flush valve.

OBJECTS AND ADVANTAGES

Accordingly, besides the objects and advantages of the beverage holder with advertising display described in my above patent, several objects and advantages of the present invention are:

(a) To provide a design that does not require the removal of a flush valve cover.

(b) To provide an installation of this product does not require the use of any additional tools or storage of any unused flush valve parts (c) To provide a large eye level advertisement platform.

(d) To provide a simple and effective way of fastening the invention to a urinal flush valve. The vice-like fastening allows for quick installation and greater marketability of the product. In the case of installation in a stadium setting it would require much less time and labor to mount the product than the "Flush valve mounted beverage holder and associated method" U.S. Pat. No. 6,243,885.

(e) To provide a design that does not require the production of several embodiments to attain additional features such as a cigarette holder or installation on an automatic flush valve. The base and beverage holder can be positioned in such a way as to not block the sensors on automatic flush valves. Still further objects and advantages will become apparent from a consideration of the ensuing description and drawings.

SUMMARY

With the foregoing in mind, the present intention advantageously provides a beverage container holder, advertising display and cigarette holder connected to the flush valve housing of a sanitary fixture such as a urinal or toilet with zero modification to the existing flush valve. The invention is comprised of three pieces. The first piece is the base and beverage holder. The base of the invention has a 1" threaded opening and four legs with teeth at the bottom of each. The beverage holder is a part of the base mold projecting out from the flush valve displaying a beverage holder for the consumer to place their beverage. The beverage holder is constructed with a small 1" circular opening to drain any excess fluid. Additionally, the beverage holder has a semi-circular extraction on either side of the rim of the cylinder to provide a resting place for a cigarette.

The invention also includes a shaft that serves two purposes. The shaft is constructed with threading on the bottom end and a hexagonal shape at the top. The first purpose of the shaft is to fasten the beverage holder to the flush valve. This is attained by the threaded shaft screwing through the threaded opening in the base and into the top of the flush valve forming a vice like effect thereby fastening the beverage holder to the flush valve. The teeth of the base are pulled up tightly beneath the ledge of the flush valve while the shaft tightens down on top of the flush valve creating a stable product for resting a beverage on. The second purpose of the shaft is to serves as a stabilizer for the advertisement display. This attained by the hexagonal shape of the top of the shaft. The top of the shaft fits into the female hexagonal shaped piece located in the back of the advertisement display.

The advertisement display is constructed to provide an envelope slot at the top of the display for the placement of an 8½×5½ sheet of paper. The back of the advertisement display contains a female hexagonal slot to mount on to the shaft. This construction allows for the product to be mounted by fastening the shaft through the threading of the base plate. Once the beverage holder is fastened tightly on to the flush valve, the advertising display can be mounted on to the shaft.

The Beverage holder with advertising display to be mounted on a flush valve with zero modification provides benefits to several parties involved. The consumer is provided a stable structure to place their beverage in, and entertainment in the form of visual and mental stimulation via information or advertising.

The property owner of the restroom (Bar, Stadium, etc) is providing an additional service to their patrons, as well as, opens up a potential revenue source by creating a new space to sell advertising to other businesses, or to publicize upcoming events and specials. The distributor (Ex: Budweiser) is given the opportunity to increase their brand awareness through the placement of their logo directly on to the product.

DRAWINGS

Drawing Figures

Some of the features, advantages, and benefits of the present invention having been stated, others will become apparent as the description proceeds when taken in conjunction with the accompanying drawings in which.

Figure 3:
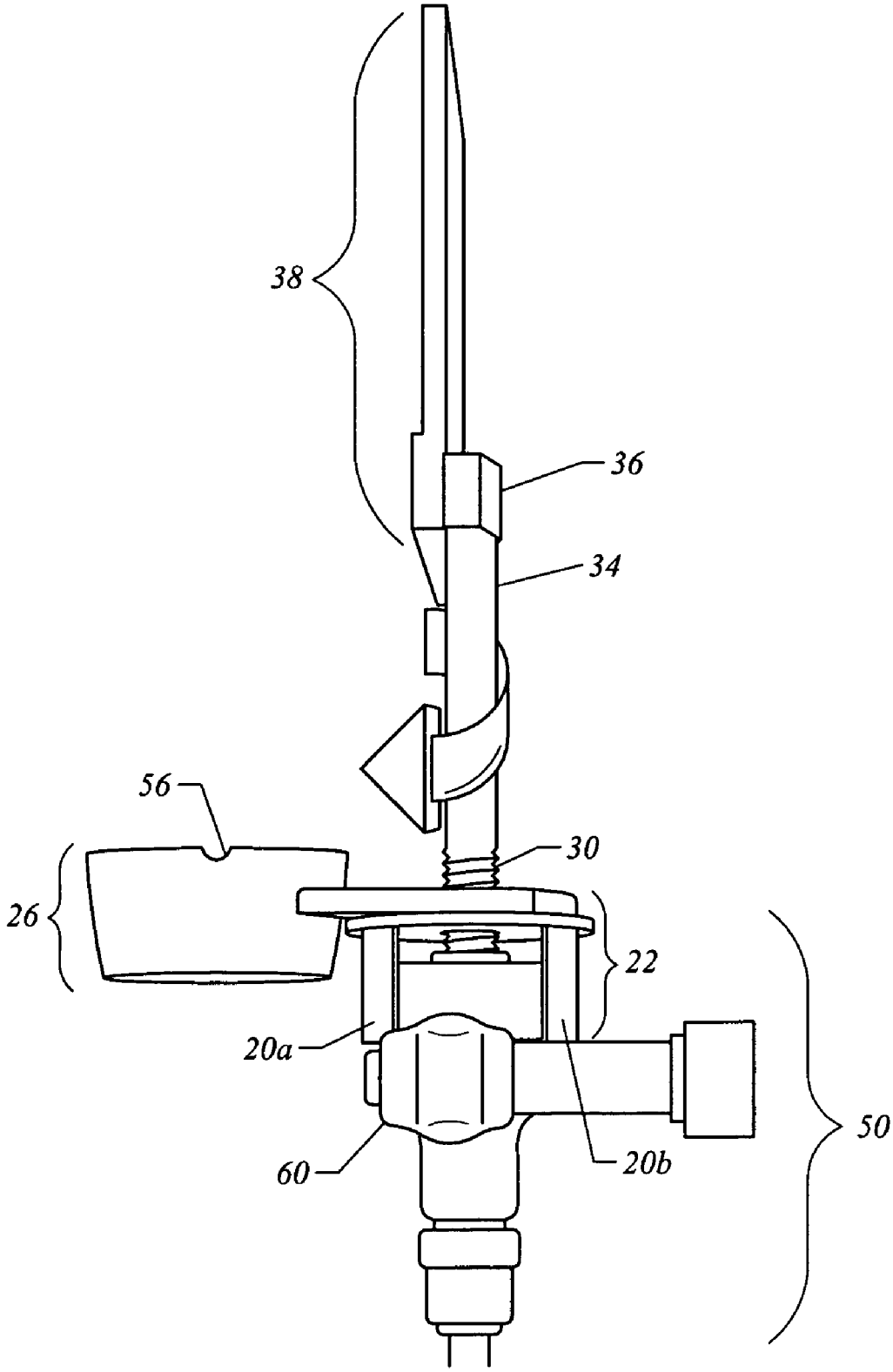
Figure 4:
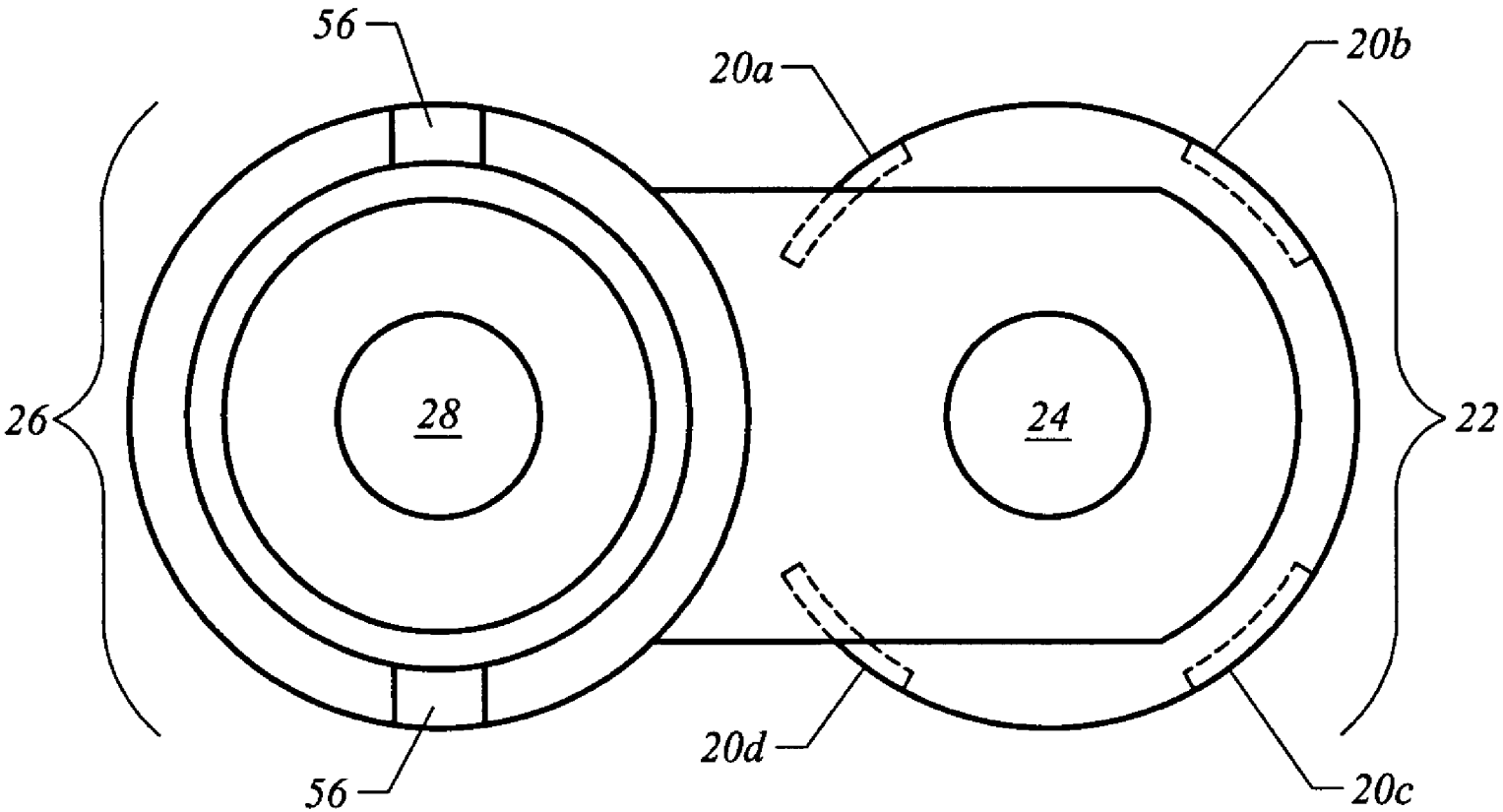
Figure 5:
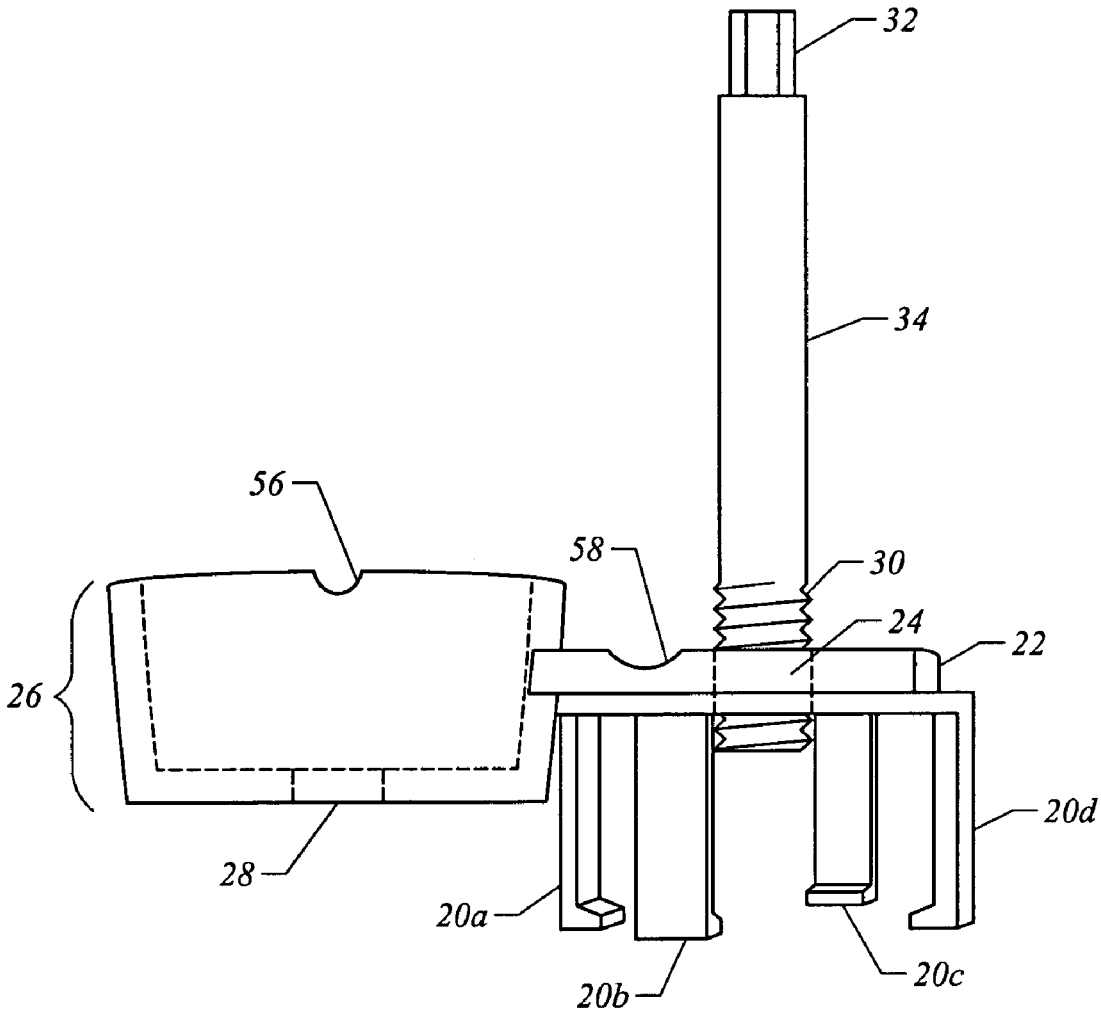
Figure 6:
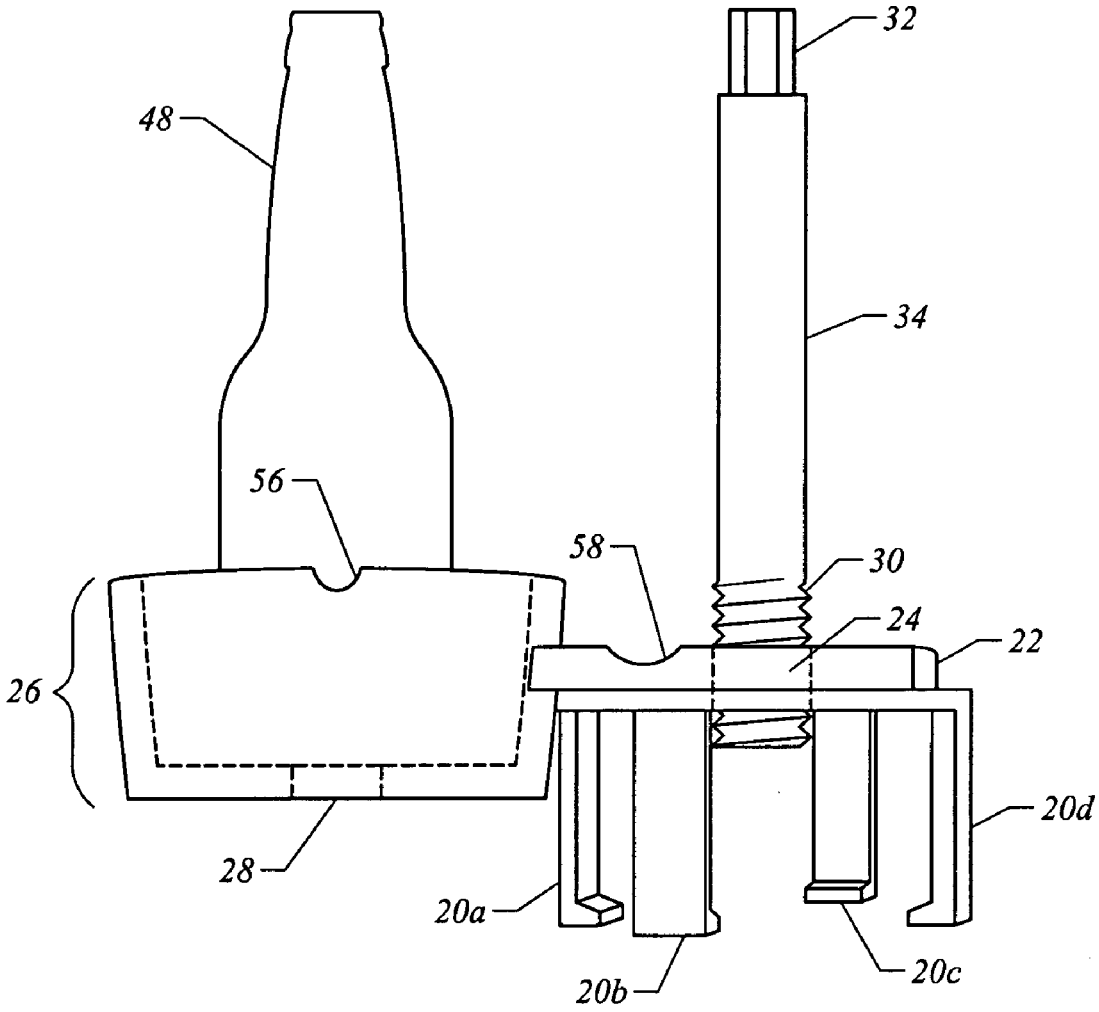
Figure 7:
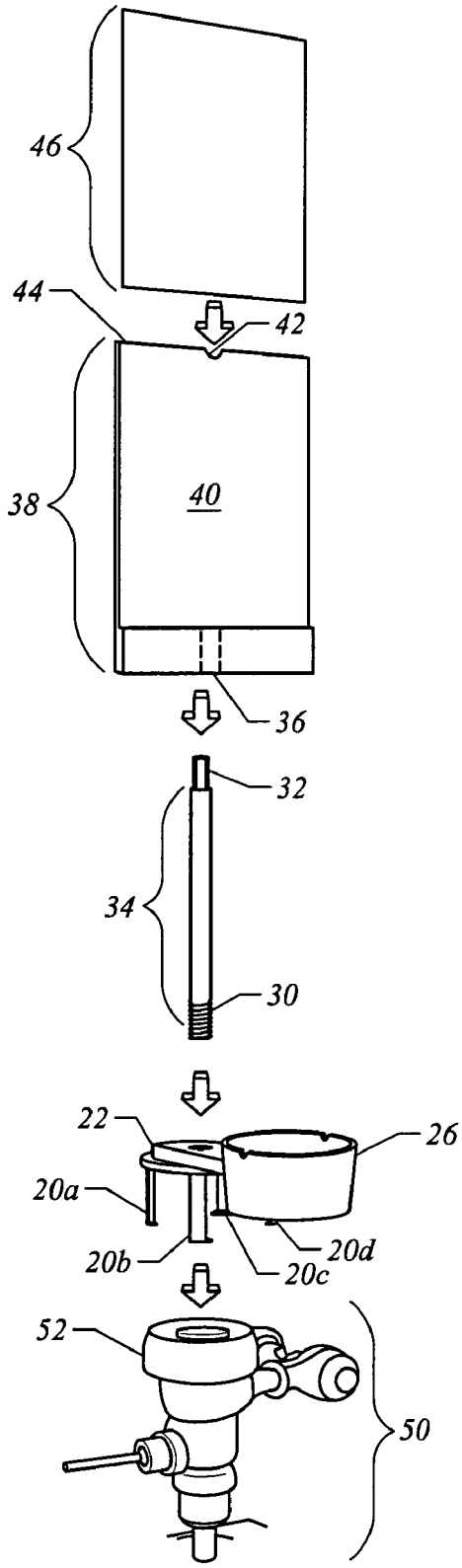
Figure 8:
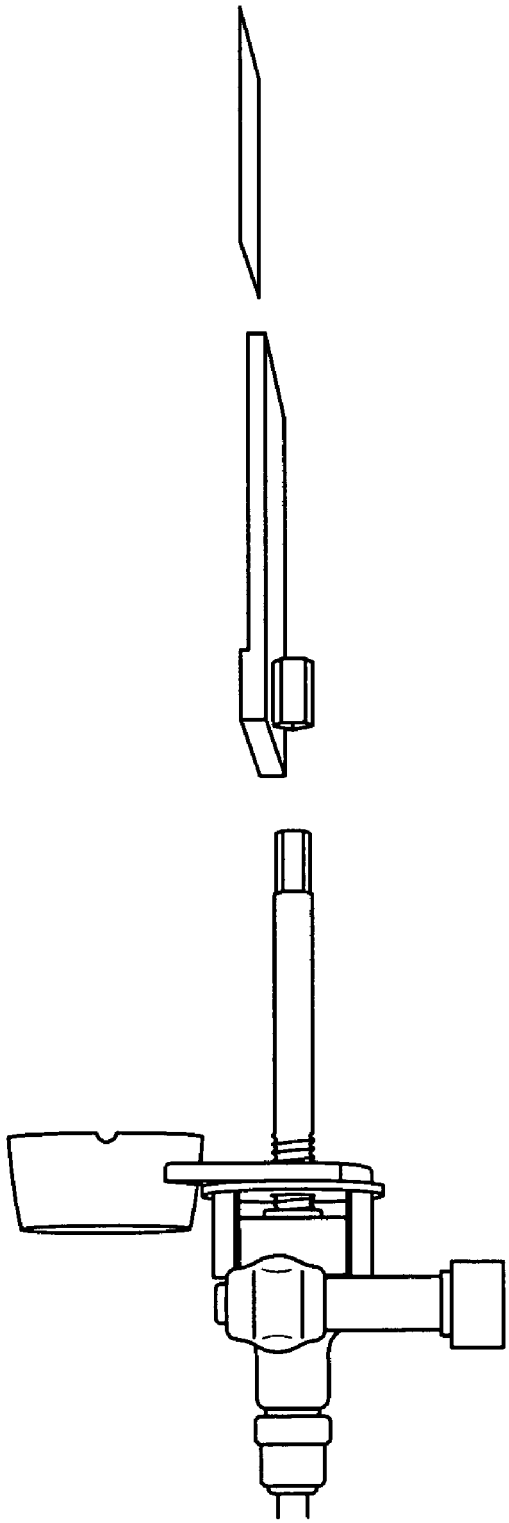
Figure 9:
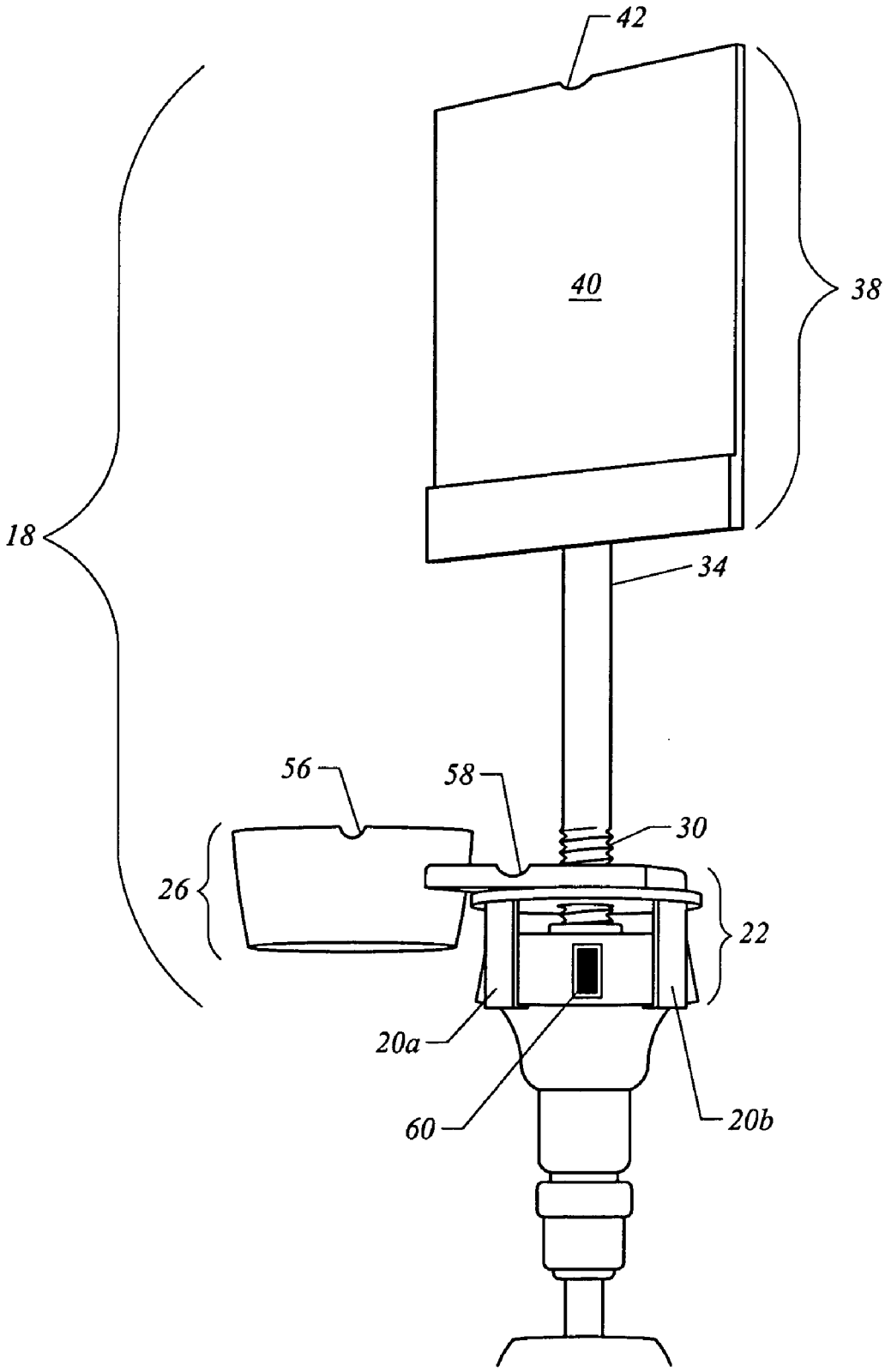

FIG. 3 shows a sequential view illustrating the second and final step in fastening the holder to the flush valve housing via screwing the male threaded shaft through the female threaded opening in the base of the invention and down onto the top of the flush valve, whereby the teethed legs of the base are tightly pulled up under the flush valve ledge creating a vice-like secure fastening of the invention;

FIG. 4 is a top plan view of the inner cavity of the beverage container holder and base connection in one embodiment of the invention;

FIG. 5 is a side elevation showing a drain opening in the floor of the inner cavity and a threaded opening in the base connection as well as teethed legs for fastening to the flush valve;

FIG. 6 is a side elevation showing the holder with a bottle therein;

FIG. 7 is a perspective view that illustrates a method of advertising by the placement of the advertisement display on top of the shaft;

FIG. 8 is a side elevation illustrating a method of advertising by the placement of the advertisement display on top of the shaft;

FIG. 9 illustrates an embodiment for using with automatic flush sensor unit.

Reference Numerals In Drawings

| | |
|---|---|
| 18 beverage holder with advertising display | 20 Teethed Legs (a, b, c, d) |
| 22 base of holder | 24 threaded female opening |
| 26 beverage holder | 28 drain |
| 30 male threading | 32 hexagonal male key |
| 34 shaft | 36 hexagonal female slot |
| 38 advertisement display | 40 ad display window |

-continued

| | |
|---|---|
| 42 thumbnail cut out | 44 advertisement display slot |
| 46 advertisement card | 48 beverage container |
| 50 flush valve | 52 flush valve ledge |
| 56 cigarette holder | 58 cigar holder |
| 60 flush sensor | |

DETAILED DESCRIPTION

The present invention will now be described more fully hereinafter with reference to the accompanying drawings, in which preferred embodiments of the invention are shown. This invention may, however, be embodied in many different forms and should not be construed as limited to the illustrated embodiments set forth herein. Rather, these illustrated embodiments are provided so that this disclosure will be thorough and complete, and will fully convey the scope of the invention to those skilled in the art. FIGS. 1 through 10 illustrate various embodiments of the present invention, which will be further described below.

Figure 1:
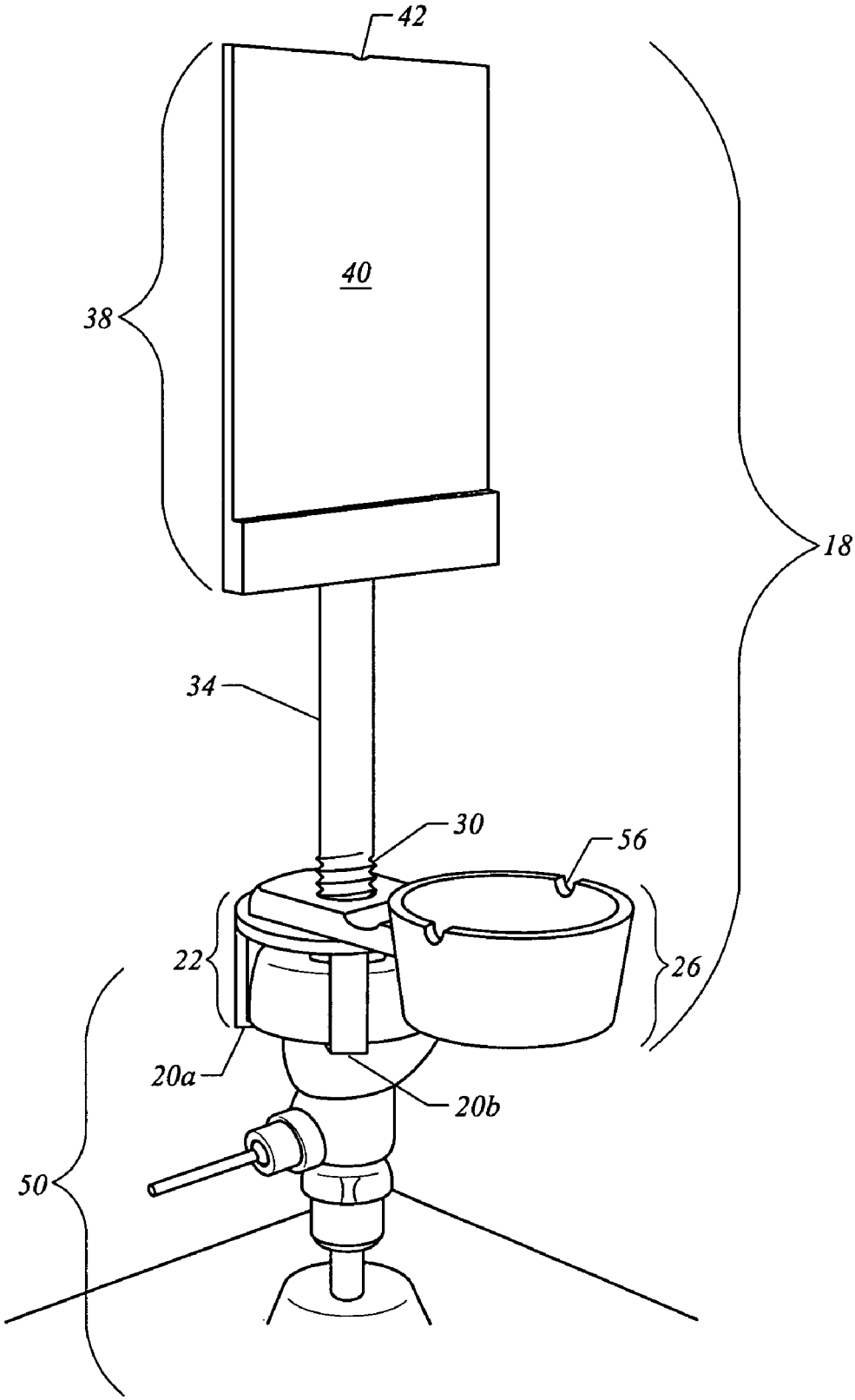
FIG. 1 is a perspective view of the flush valve mounted holder according to an embodiment of the present invention.
Figure 2:
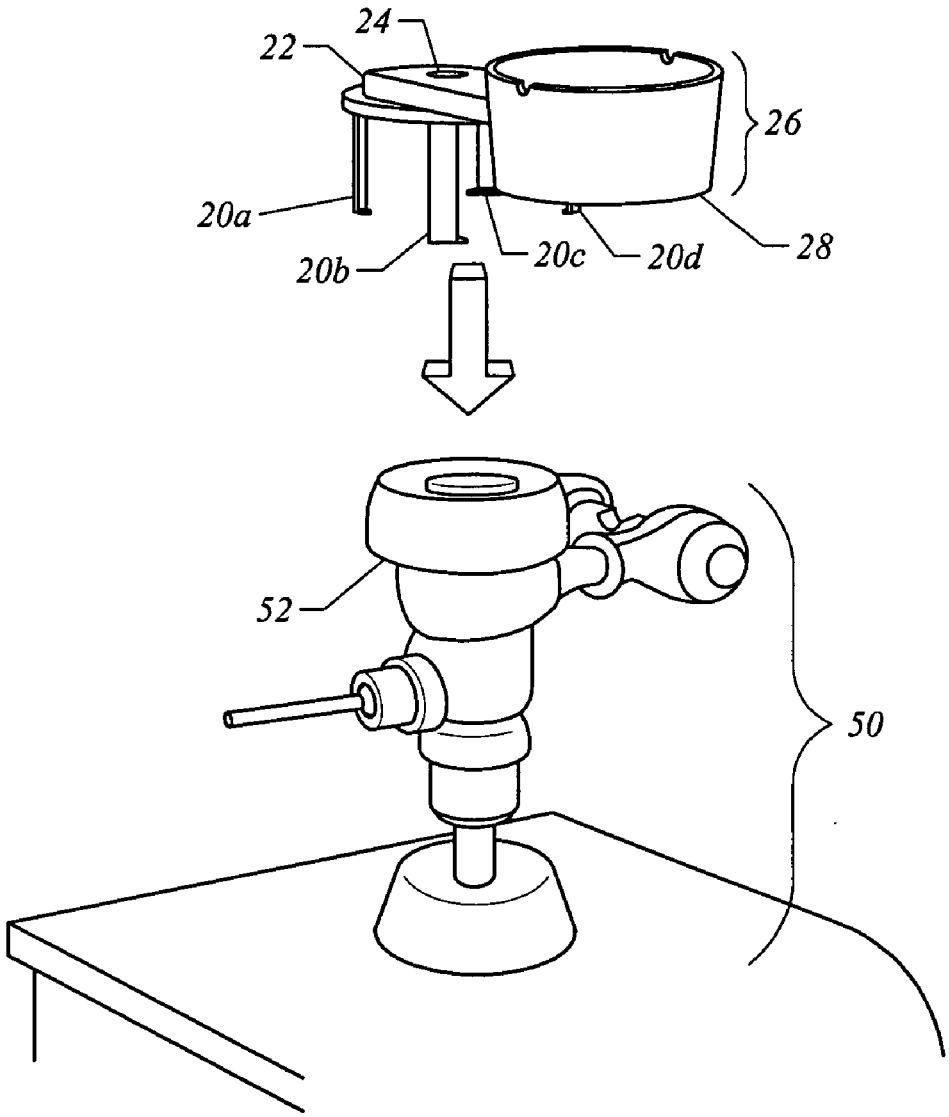
FIG. 2 shows a sequential view illustrating the first of two simple steps to connect the holder to the flush valve housing via snapping teeth into place under the ledge of the flush valve.

FIG. 1 illustrates the combination beverage holder with advertising display 18 in place connected to the flush valve 50 housing of a commercial sanitary fixture. FIG. 2 depicts the first of two-step process for connecting the combination beverage holder with advertising display 18. The combination holder 18 has four teethed legs 20 *a, b, c* and *d*, and a threaded opening 24 in the base 22 of the combination holder 18. As illustrated in FIG. 2, the teethed legs 20 *a, b, c* and *d* snap into place underneath the flush valve ledge 52 in a commercial sanitary fixture such as a urinal or toilet. In the preferred embodiment, the teethed legs 20 *a, b, c* and *d* are made of a flexible plastic to allow them to bend around the flush valve cover. Additionally, the combination holder 18 includes an extension from the base 22 in the form of a beverage holder 26. The beverage holder 26 is constructed with a drain 28 positioned at the floor of the inner cavity to provide a fluid outlet from the cavity to the outside, to thereby substantially drain liquid that might accumulate within the beverage holder 26.

FIG. 3 depicts the final step in fastening the combination holder 18 to said flush valve 50. The base 22 contains a threaded female opening 24 to complete the connection to said flush valve 50, to thereby mount the combination holder 18 onto the flush valve 50 as best seen in FIGS. 2 and 3. The shaft 34 is constructed with male threading 30 at the base 22. The shaft 34 is screwed through the threaded female opening 24 in the base 22 of combination holder 18 and down into the top of the flush valve 50, whereby the teethed legs 20 *a, b, c* and *d* of the base 22 are tightly pulled up under the flush valve ledge 52. The combination of this two-step installation process creates a vice-like fastening of the combination holder 18 to said flush valve 50.

The beverage holder 26 is connected to the base 22 and extends to provide a shape suitable for holding at least one item for a person using the sanitary fixture as FIG. 6 depicts. Additionally, the combination holder 18 possesses a cigarette holder 56 and a cigar holder 58, illustrated in FIGS. 4 and 5.

FIGS. 7 and 8 depict the connection of a changeable advertising platform to the shaft 34 of the combination holder 18 of this invention. The hexagonal male key 32 at the top of the shaft 34 serves as a stable connection for the advertisement display 38. The back of the advertisement display 38 is constructed with a hexagonal female slot 36 to fit onto the top of the hexagonal male key 32 on top of the shaft 34. Additionally, the advertisement display 38 is constructed to provide an advertisement display slot 44 at the top of the display for the placement of an 8½×5½ advertisement card 46. The top of the advertisement display has a thumbnail opening to make it easy to insert and remove the advertisement cards 46. The front wall of the advertisement display display 38 is transparent, thereby providing a changeable advertising platform connected to the commercial sanitary fixture.

As shown in FIG. 9 , the present invention may be preferably configured to provide a flush valve mounted combination holder 18 onto an automatic flush valve 50. Such automatic flush valves 50 are usually activated by an optical sensor 60 positioned inside the flush valve 50 cover, as shown in FIG. 9. The flush valve cover is made of a material suitable for the sensor 60 to obtain sensing information through it. As seen in FIG. 9, the invention can be positioned at any desired angle to prevent the blocking of the automatic flush valve sensor 60.

In addition, as illustrated in FIGS. 1 through 9, the present invention includes a method of mounting a combination holder 18 on a flush valve 50 of a commercial sanitary fixture such as a urinal or toilet having a flush valve 50.

The method includes the step of providing a holder 18 with a beverage holder 26 having a shape suitable for holding at least one item for a person, and the step of connecting the combination holder 18 to the flush valve 50 by snapping the teethed legs 20 *a, b, c,* and *d* under the flush valve ledge 52 and screwing the male threading 30 of the shaft 34 through the threaded female opening 24 in the base 22 of the combination holder 18 and down onto the top of the flush valve 50. The combination of the above two-step installation process creates a vice-like fastening of the combination holder 18 to said flush valve 50.

Additionally, as shown in FIGS. 7 and 8, the present invention includes a method of advertising which includes the step of connecting an advertisement display 38 to the shaft 34 of the combination holder 18 of this invention, thereby creating an advertisement platform connected to a commercial sanitary fixture such as a urinal or toilet. In the present invention, the combination holder 18 is an augmentation to the flush valve 50. This functional augmentation provides the added benefit of serving as a combination holder 18 for a beverage container 48. The method may further include the step of providing the functionally equivalent part in a predetermined color, to thereby promote a sports team, liquor distributor or entity associated with that color. Also, the method may further provide for including a predetermined logo on the combination holder 18 or advertisement display 38 to thereby promote a specified entity such as a sports team or liquor distributor associated with the log.

Operation

The manner of installing the beverage holder and advertising display 18 to a flush valve 50 is accomplished via following steps:

(a) As illustrated in FIG. 2, the teethed legs 20 *a, b, c* and *d* snap into place underneath the flush valve in a commercial sanitary fixture such as a urinal or toilet. In the preferred embodiment, the teethed legs 20 *a, b, c* and *d* are made of a flexible plastic to allow for them to bend around the flush valve cover.

(b) FIG. 3 depicts the final step in fastening the combination holder 18 to said flush valve 50. The base 22 contains a threaded female opening 24 to complete the connection to said flush valve 50, to thereby mount the combination holder 18 onto the flush valve 50 as best seen in FIGS. 2 and 3. The shaft 34 is constructed with male threading 30 at the base. The shaft 34 is screwed through the threaded female opening 24 in the base of holder 22 and down into the top of the flush valve 50, whereby the teethed legs 20 *a, b, c* and *d* of the base 22 are tightly pulled up under the flush valve ledge 52. The combination of this two step installation process creates a vice-like fastening of the combination holder 18 to said flush valve 50.

(c) FIGS. 7 and 8 depict the connection of a changeable advertising platform to the shaft 34 of the invention. The hexagonal male key 32 at the top of the shaft 34 serves as a stable connection for the advertisement display 38. The back of the advertisement display 38 is constructed with a hexagonal female slot 36 to fit onto the top of the hexagonal male key 32 on top of the shaft 34.

Additionally, the advertisement display 38 is constructed to provide an advertisement display slot 44 at the top of the display for the placement of an 8½×5½ advertisement card 46. The top of the advertisement display has a thumbnail opening to make it easy to insert and remove the advertisement cards 46. The front wall of the advertisement display 38 is transparent, thereby providing a changeable advertising platform connected to the commercial sanitary fixture.

CONCLUSION, RAMIFICATIONS AND SCOPE

Accordingly, the reader will see that the beverage holder with advertising display can be mounted on a flush valve with zero modification. The design that does not require the removal of a flush valve cover. The installation of this product does not require the use of any additional tools or storage of any unused flush valve parts. The large eye level advertisement platform creates an incredible opportunity for targeting a very captive audience. This will provide a new revenue source for property owners in the selling of advertisement space. Additionally, this new advertisement platform will increase brand awareness of any sponsor or buyer of the beverage holder via logo placement and/or company colors. Furthermore, the consumer is provided with a great convenience in the form of a beverage/cigarette holder and information dispenser via the advertisement display. The simplicity and effectiveness of the vice-like fastening of the invention to the flush valve allows for quick installation and great marketability of the product. In the case of installation in a stadium setting it would require very little time and labor to mount the product. The design provides several functions without having to create additional embodiments, such as, a cigarette and cigar holder or the installation on an automatic flush valve. The base and beverage holder can be positioned in such a way as to not block the sensors on automatic flush valves. The beverage holder can be position directly in front of the flush valve or to the right or left depending upon where the sensor is located. Once the beverage holder is position in the desired state, the shaft can be screwed through the base of the invention and on to the top of the flush valve cover. Once the shaft is screwed tightly down on to the top of the flush valve and the teethed legs of the invention are pulled up tightly beneath the ledge of the flush valve, the Advertising Display can be placed on top of the Shaft to complete the installation of the invention.

Although the description above contains much specificity, these should not be construed as limiting the scope of the invention but merely providing illustrations of some of the presently preferred embodiments of this invention. For example, the beverage holder can connect to alternate locations on the flush valve, such as, the control stop or the covering tube. The advertising display can be replaced with an animated computer screen.

Thus the scope of the invention should be determined by the appended claims and their legal equivalent, rather than by the examples given.

That which is claimed:

1. A holder connected to a flush valve housing in a commercial sanitary fixture for holding a beverage thereon, said holder comprising:

a base having a threaded hole in the center and four legs separated evenly with protruding teeth at the bottom of the legs, the teeth lodge underneath the flush valve housing; and, a beverage holder connected to the base having a shaped body for holding at least one item.

2. The holder of claim 1, wherein the base and the body are fabricated as one integral part.

3. The holder of claim 1, wherein the body further includes a cylinder cavity and an opening positioned in the middle of a floor of the beverage holder to provide a fluid outlet from the cylinder cavity to the outside to thereby substantially drain liquid accumulating within the cylinder cavity.

4. The holder of claim 1 further comprises a threaded shaft for fastening the holder to the flush valve housing.

5. The holder of claim 4, wherein said shaft screws through the threaded opening in the base plate and onto the top of the flush valve for fastening the holder to the flush valve; wherein the teeth of the legs are pulled up tightly beneath the ledge of the flush valve while the shaft tightens down on top of the flush valve to stabilize the holder.

6. The holder of claim 5, wherein said shaft further includes a hexagonal shape at an end opposite the threaded end.

7. The holder of claim 6, wherein said shaft connects to an advertising display via a female hexagonal slot located on the back of said advertising display.

8. The holder of claim 7, wherein said advertising display is constructed in the likeness of a picture.

9. The holder of claim 8, wherein said advertising display has a transparent plastic wall in front.

10. The holder of claim 9, wherein said transparent front wall provides an advertising platform at eye level.

11. The holder of claim 10, wherein said advertising display is constructed with an opening at a top end for receiving a sheet of paper to thereby provide a changeable eye level advertising platform connected to the commercial sanitary fixture.

12. The holder of claim 1, wherein the legs have a sufficient length to provide ample room between the flush valve and the top of the base.

13. The holder of claim 1, wherein the holder is adapted to position on the flush valve at a position that would prevent the blocking of an automatic flush valve sensor.

14. A holder connected to a flush valve housing in a commercial sanitary fixture for holding a beverage thereon, said holder comprising:

a base having a plurality of depending legs with distal ends having protruding teeth, wherein the teeth are sized and configured to lodge underneath the flush valve housing to retain the base on the flush valve housing; and, a beverage holder connected to the base having a shaped body for holding at least one item.

* * * * *